US007236082B2

(12) United States Patent
Kuo

(10) Patent No.: US 7,236,082 B2
(45) Date of Patent: Jun. 26, 2007

(54) CIRCUIT BREAKER STRUCTURE

(76) Inventor: Wan-Kuo Kuo, P.O. Box 82-144, Taipei (TW)

( * ) Notice: Subject to any disclaimer, the term of this patent is extended or adjusted under 35 U.S.C. 154(b) by 389 days.

(21) Appl. No.: 11/020,157

(22) Filed: Dec. 27, 2004

(65) Prior Publication Data

US 2005/0140489 A1 Jun. 30, 2005

(30) Foreign Application Priority Data

Dec. 25, 2003 (TW) ..... 92222632 U

(51) Int. Cl.
*H01H 37/70* (2006.01)
*H01H 37/52* (2006.01)

(52) U.S. Cl. ..... 337/66; 337/56; 337/72

(58) Field of Classification Search ..... 337/56, 337/72, 66; 200/339, 341
See application file for complete search history.

(56) References Cited

U.S. PATENT DOCUMENTS

| | | | | |
|---|---|---|---|---|
| 3,932,829 | A * | 1/1976 | Ellenberger | 337/49 |
| 4,258,349 | A * | 3/1981 | Flory | 337/46 |
| 4,329,669 | A * | 5/1982 | Krasser et al. | 335/20 |
| 4,338,586 | A * | 7/1982 | Scanlon | 337/74 |
| 4,345,233 | A * | 8/1982 | Matthies | 337/75 |
| 4,528,538 | A * | 7/1985 | Andersen | 337/43 |
| 4,833,439 | A * | 5/1989 | Bowden et al. | 337/68 |
| 4,922,219 | A * | 5/1990 | Bakhaus et al. | 337/74 |
| 5,089,799 | A * | 2/1992 | Sorenson | 337/68 |
| 5,223,813 | A * | 6/1993 | Cambreleng et al. | 337/66 |
| 5,264,817 | A * | 11/1993 | Sorenson | 337/68 |
| 5,491,460 | A * | 2/1996 | Krasser et al. | 337/70 |
| 5,760,672 | A * | 6/1998 | Wang | 337/79 |
| 5,892,426 | A * | 4/1999 | Huang | 337/59 |
| 6,275,134 | B1 * | 8/2001 | Chen | 337/37 |
| 6,307,460 | B1 * | 10/2001 | Yu | 337/37 |
| 6,400,250 | B1 * | 6/2002 | Wang | 337/66 |
| 6,445,273 | B1 * | 9/2002 | Yu | 337/37 |
| 6,456,185 | B1 * | 9/2002 | Yu | 337/37 |
| 6,512,441 | B1 * | 1/2003 | Yu | 337/37 |
| 6,552,644 | B2 * | 4/2003 | Yu | 337/66 |
| 6,563,414 | B2 * | 5/2003 | Yu | 337/66 |
| 6,617,952 | B1 * | 9/2003 | Yu | 337/94 |
| 6,621,402 | B2 * | 9/2003 | Huang | 337/66 |
| 6,664,884 | B1 * | 12/2003 | Yu | 337/59 |
| 6,674,033 | B1 * | 1/2004 | Wang | 200/334 |
| 6,714,116 | B1 * | 3/2004 | Sang et al. | 337/68 |

(Continued)

FOREIGN PATENT DOCUMENTS

FR 2605142 A1 * 4/1988

*Primary Examiner*—Anatoly Vortman
(74) *Attorney, Agent, or Firm*—Leong C. Lei

(57) ABSTRACT

An improved structure of a circuit breaker is provided which comprises a housing, a rocker-switch, a push-shaft, a pull-shaft, a bimetallic strip, and other parts. There are three terminals under the rocker-switch inside the housing. A bimetallic strip embedded in a groove under the pull-shaft makes contact with that pull-shaft through a silver point at one end. The bimetallic strip also makes contact with the push-shaft at the other end using another silver point. Both the pull-shaft and the push-shaft are connected with a curved spring installed inside the V-shaped slot on an adjustment strip. The bimetallic strip, curved spring, and both the pull-shaft and the push-shaft constitute the main control mechanism that provides the circuit breaking action under overloading condition.

5 Claims, 5 Drawing Sheets

U.S. PATENT DOCUMENTS 6,734,779 B2 * 5/2004 Yu ..... 337/59
6,788,186 B1 * 9/2004 Yu ..... 337/66
2003/0160679 A1 * 8/2003 Yu ..... 337/37

* cited by examiner

CIRCUIT BREAKER STRUCTURE

BACKGROUND OF THE INVENTION (a) Technical Field of the Invention

The present invention generally relates to circuit breaking devices, and more particularly to an improved circuit breaker structure that returns the circuit breaker back to the OFF state automatically.

(b) Description of the Prior Art

The ordinary circuit breakers utilize the ON and OFF action mechanism to prevent overheating, fire, and other hazardous accidents as a result of current overloading in electrical circuitries. The circuit breaker also has the characteristic of being able to return back to closed-circuit state after overloading condition is eliminated. However, safer, simplified operating mechanism and lower cost are still pursued by circuit breaker manufacturers.

Reviewing two previously awarded patent rights can provide an understanding of the mechanisms and shortcomings of prior arts of making circuit breakers.

The first one reviewed is Patent Number 208384, A Circuit Breaker Structure with Protective Circuit. Its main structure consists of three sets of plates. The center plate has a platinum point on it. The side plate also has a platinum point on it and a spring riveted to it. The center plate and the side plate make contact with each other at the two platinum points. The raised edge of the riveted spring then touches a curved spring. The slot at the lower portion of another moving plate is grooved between the raised edge of the riveted spring and the platinum point on that plate. The other end of this moving plate is inserted into a push-shaft through a hole to form a lever. The high temperature from current overloading makes the lever under the push-shaft to rise up and press the push-shaft, causing the separation of the two platinum points on the center plate and the plate with riveted spring, which in turn opens the circuit and stops the current flow. There is an adjustment screw inside the groove of the curved spring which can be used to make minute adjustment of the angle of the curved spring according to specified load values of voltage and amperage.

Next, following characteristics can be found in Patent Number 540812, Safe Circuit Breaker Lever Structure. This design features a chamber designed for the movement of an alloyed lever. The alloyed lever connects the switching element of the ON/OFF action with the open-close structure made of alloyed plates. The operating steps are depicted below:

First, under normal operating conditions, the ON/OFF action of the switching element is completed in a single movement and does not involve the alloyed lever.

Secondly, when current flows in the ON state, the alloyed lever expands freely in the chamber under heating which is generated from current flowing through the open-close structure of this circuit breaker. When the alloyed lever expands to a preset point, it will separate from the switching element, and the circuit breaker goes into the OFF state to avoid fire hazard from current overloading.

Thirdly, after the factors causing overloading are removed while the circuit breaker is at the OFF state, the switching element must be pressed once to make the alloyed lever to go into the opposite direction and return the circuit breaker to its normal OFF position.

As described in the aforementioned manner, the safe circuit breaker lever structure indeed do cut off the current flow under overloading condition to prevent overheating and assure safe electrical operation. Both steps 1 and 2 are normal and reasonable in the usual power switch devices. However, according to what is stated in step 3, in order to get the circuit breaker back to the normal OFF state requires a pressing action on the switching element, which is an unnecessary and spurious step. To start the circuit breaker to conduct current again, an operator needs to press the switching element again. Therefore, it takes two steps to re-start the electrical circuit. It is for this reason the construction of a chamber for moving lever needs further improvement and simplification.

SUMMARY OF THE INVENTION

The primary purpose of the present invention is to provide an improved structure of a circuit breaker, which mainly comprises of a housing, a rocker-switch, a push-shaft, a pull-shaft, a bimetallic strip, and other parts. The rocker-switch is installed on the top of the housing. Inside the housing and underneath the rocker-switch, there are three electrical terminals. Both the pull-shaft and the push-shaft are connected to the tilted plate underneath the rocker-switch. The pull-shaft and the push-shaft are connected to a common terminal through a slotted opening inside the housing. One end of the bimetallic strip is installed at the raised portion of the terminal, and the bimetallic strip is also connected with a curved spring installed inside the V-shaped slot on an adjustment strip. This construction makes the bimetallic strip embed in a groove under the pull-shaft while the push-shaft is pressed against the bimetallic strip by another spring installed in a slot on the housing. Therefore, the bimetallic strip makes contact with the moving terminal through a silver point on itself and another silver point on the moving terminal. This mechanism makes the circuit breaker at either the ON state or the OFF state. Once the overloading factor or factors are removed, the circuit breaker returns to its original OFF state without the need for operator to press the rocker-switch twice to re-start the circuit breaker.

The design objective of the present invention is to offer an improved circuit breaker structure that returns the electrical circuitry to the original OFF state automatically. The improved mode of operation can be described in three major steps:

First, when the circuit breaker is at the ON state, the tilted plate of the rocker-switch will press both the pull-shaft and the push-shaft. These two mechanisms make the bimetallic strip contact the stationary terminal and cause the circuit breaker to conduct current.

Secondly, under the overloading condition, the spring installed on the housing expands and causes push-shaft to press the silver point on the bimetallic strip and moves it left-ward, and the force acted upon the bimetallic strip by the pull-shaft will keep it in place. As a result the bimetallic strip disengages from the stationary terminal and the circuit breaker goes into the OFF state.

Third, during the normal ON state, the bimetallic strip bends towards the opposite direction and goes into the OFF state when the rocker-switch is pressed by external force or is being overheated under overloading condition. Once the external force or the overloading condition is removed, the push-shaft is pressed by the spring on the housing and moves the bimetallic strip right-ward. This action returns the circuit breaker to its normal OFF state.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
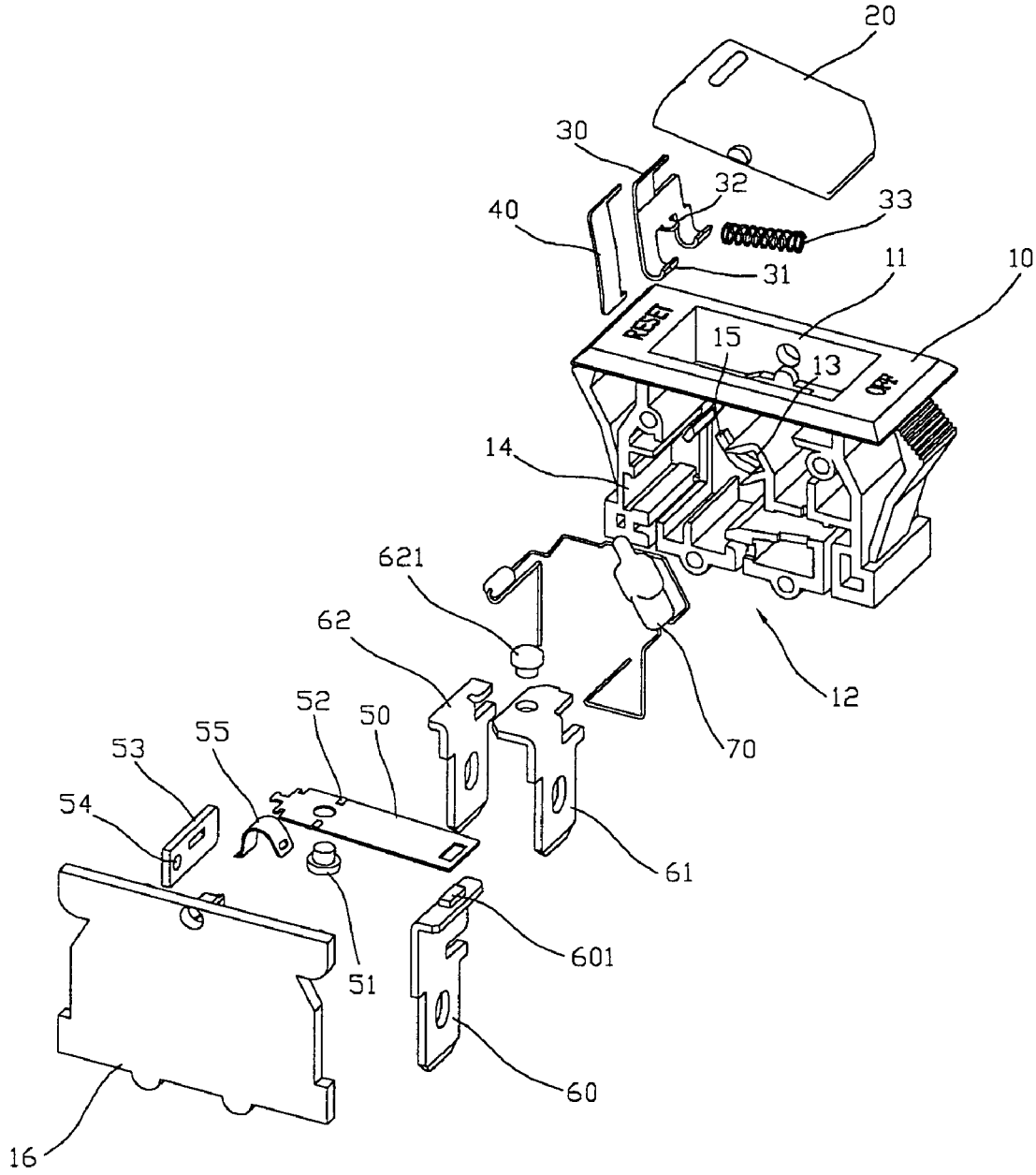
FIG. 1 is a three-dimensional perspective view showing the structure of the preferred embodiment.

In the following, detailed description along with the accompanied drawings explains fully the preferred embodiments of the present invention. As shown in FIG. 1, the present invention is an embodiment of improved structure of a circuit breaker comprising of a housing 10, a rocker-switch 20, a push-shaft 30, a pull-shaft 40, a bimetallic strip 50, three terminals 60, 61, and 62 with corresponding pivoted connections, an indicator 70, a side cover on the housing 16 to constitute a one-piece construction. The main design features are as following:

Housing 10 is an injection molded structure with a top opening to install said rocker-switch 20 and three slots 12 prefabricated at the bottom for the placement of a common terminal 60, a moving terminal 61, and a stationary terminal 62. There is a hole 22 opened on the tilted plate 21 underneath the rocker-switch 20 (not shown in FIG. 1) for the pull-shaft 40 and the push-shaft 30 to go through. The pull-shaft 40 and the push-shaft 30 are pivotally connected together. The bottom of the push-shaft 30 is a curved plate 31 (the push-shaft 30 and the curved plate 31 are pressed against the bimetallic strip 50. Both are also constrained by an arcing sliding track 15 inside the housing 10. These features cause the push-shaft 30 to move along the arcing sliding track 15 when the rocker-switch 20 is pressed. The movement of the push-shaft 30 will also cause the bimetallic strip 50 to bend downward. A silver point 51 is fabricated on a raised ridge 52 on the top side of the bimetallic strip 50. When the electrical circuitry is at the ON state, pressing the rocker-switch 20 will push the push-shaft 30. The curved plate 31 and an L-shaped plate 32 at center of the housing 10 are being held in place inside a spring slot 13 by a holding spring 33.

The bimetallic strip 50 is connected to a raised point 601 on the common terminal 60. The front end of the bimetallic strip 50 is connected to the adjustment strip 53 which is in turn installed on the slot for adjustment strip 14 on the housing 10. There is a V-shaped slot 54 on adjustment strip 53 to hold the curved spring 56. With different sizes of the adjustment strip the bimetallic strip 50 can be designed for applications intended. Using the different forces of the curved spring 56, the bimetallic strip 50 can change the loading coefficients of the circuit breaker. A round hole 55 is opened on said bimetallic strip 50 for easy replacement of said adjustment strip. When the bimetallic strip 50 is at the groove of the pull-shaft 40, it is connected to the curved spring 56. The push-shaft 30 is at the normal OFF state and is being pressed towards the outside by the holding spring 33 which place the bimetallic strip 50 at the lower part of the groove on the pull-shaft 40. The silver point 51 on the bimetallic strip 50 is disconnected from the sliver point 621 on the stationary terminal 62 and is being held in place by the edge cover 16 of the housing 10.

The objective of the present invention is to provide a simplified structure that returns the circuit breaker back to the open-circuit state automatically. As shown in FIGS. 2A, 2B, 3A, 3B, 4A and 4B, the operation mode of the preferred embodiment are explained below.

Figure 2A:
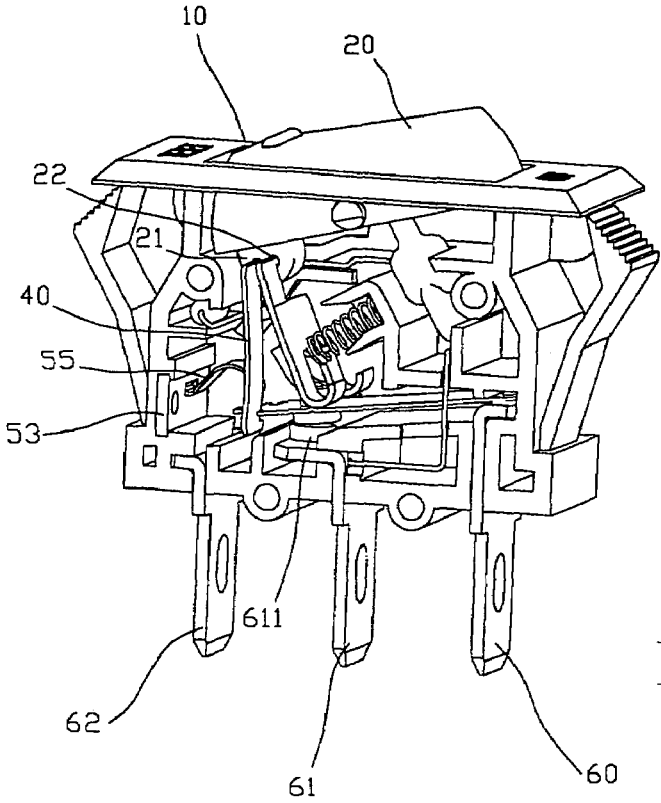
FIGS. 2A and 2B is a three-dimensional perspective view showing the preferred embodiment in the ON state.
Figure 2B:
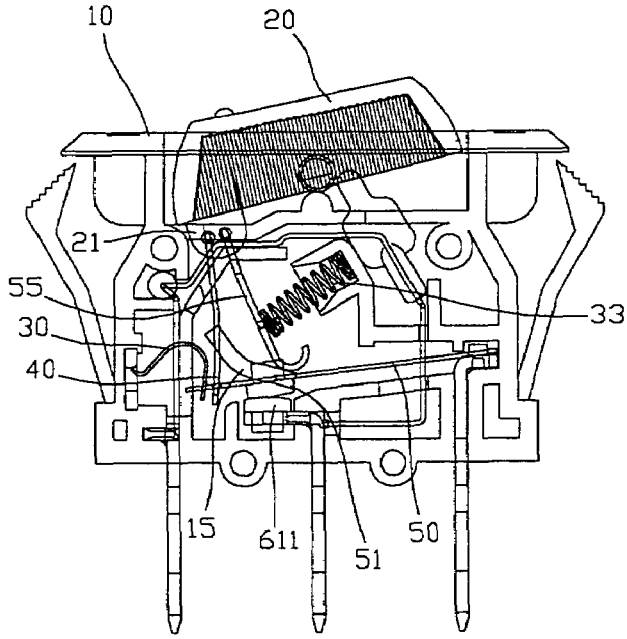

First, when the circuit breaker is at the ON state, pressing the rocker-switch 20 causes the tilted plate 21 to press down on both the push-shaft 30 and the pull-shaft 40. The push-shaft 30 exerts force from the holding spring 33 installed inside the spring slot 13 on the housing 10 on the bimetallic strip 50. At the same time, the bimetallic strip 50 is also being acted upon by the pull-shaft 40 in the groove and the curved spring 56. Both forces make the silver point 51 on the bimetallic strip 50 connect to the sliver point 621 on the stationary terminal 62. The circuit breaker is thus at the ON state as shown in FIGS. 2A and 2B.

Figure 3A:
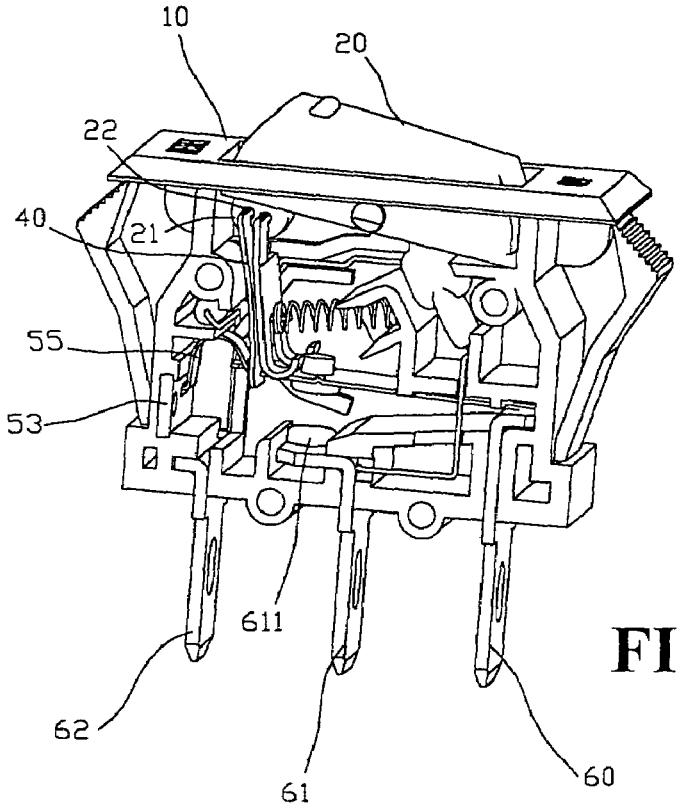
FIGS. 3A and 3B is a three-dimensional perspective view showing the preferred embodiment in the OFF state under the overloading condition.
Figure 3B:
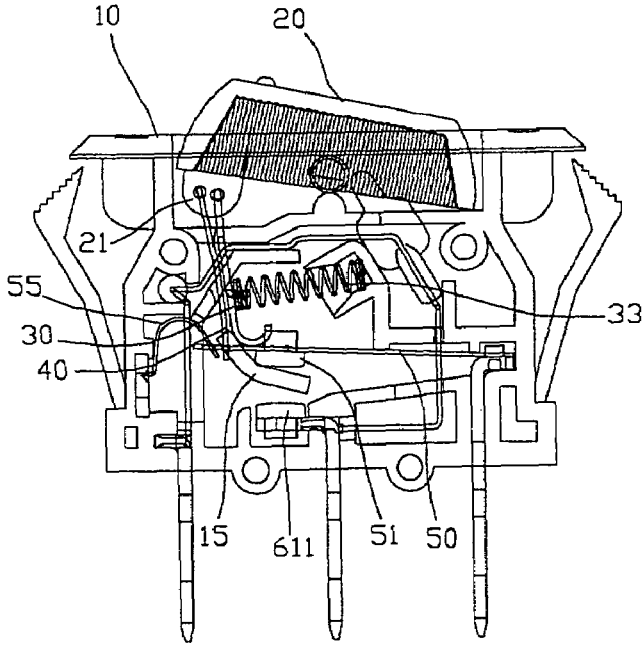

Second, when the circuit breaker is under natural overloading condition, the push-shaft 30 is pressed by force from the holding spring 33 installed inside the spring slot 13 on the housing 10. The push-shaft 30 make the silver point 51 on the bimetallic strip 50 to move left-ward which in turn make the bimetallic strip 50 to press against and is being constrained by the groove on the pull-shaft 40. This force causes the silver point 51 on the bimetallic strip 50 to disengage from the sliver point 621 on the stationary terminal 62. The circuit breaker thus jumps to the OFF state (the same as the normal OFF state) as shown in FIGS. 3A and 3B.

Figure 4A:
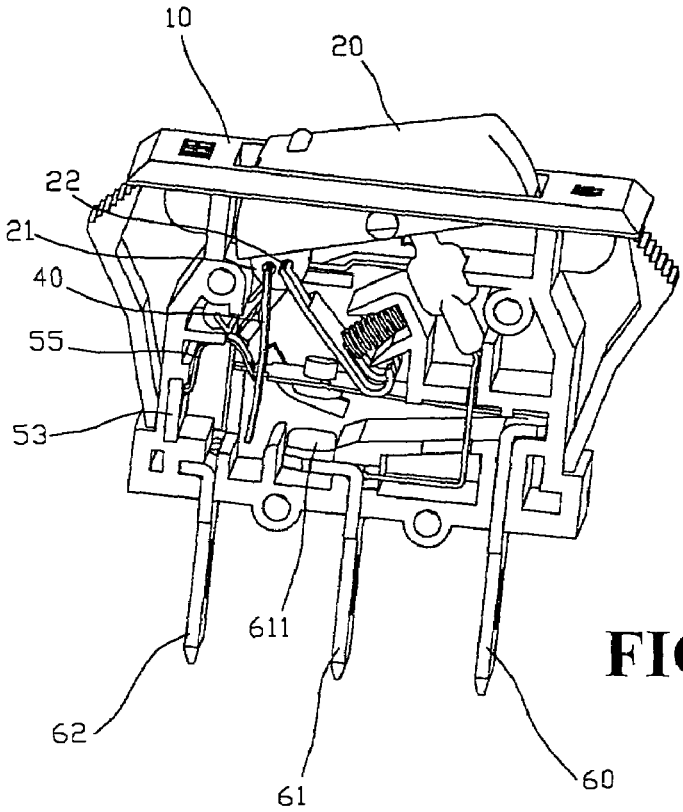
FIGS. 4A and 4B is a three-dimensional perspective view showing the preferred embodiment in the OFF state under the condition of being pressed by an external force.
Figure 4B:
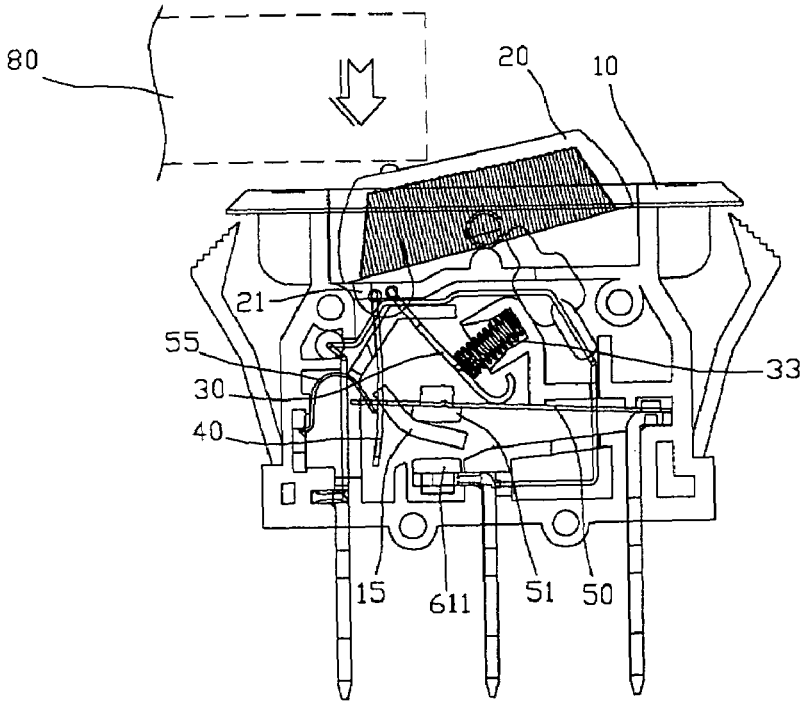
Figure 5:
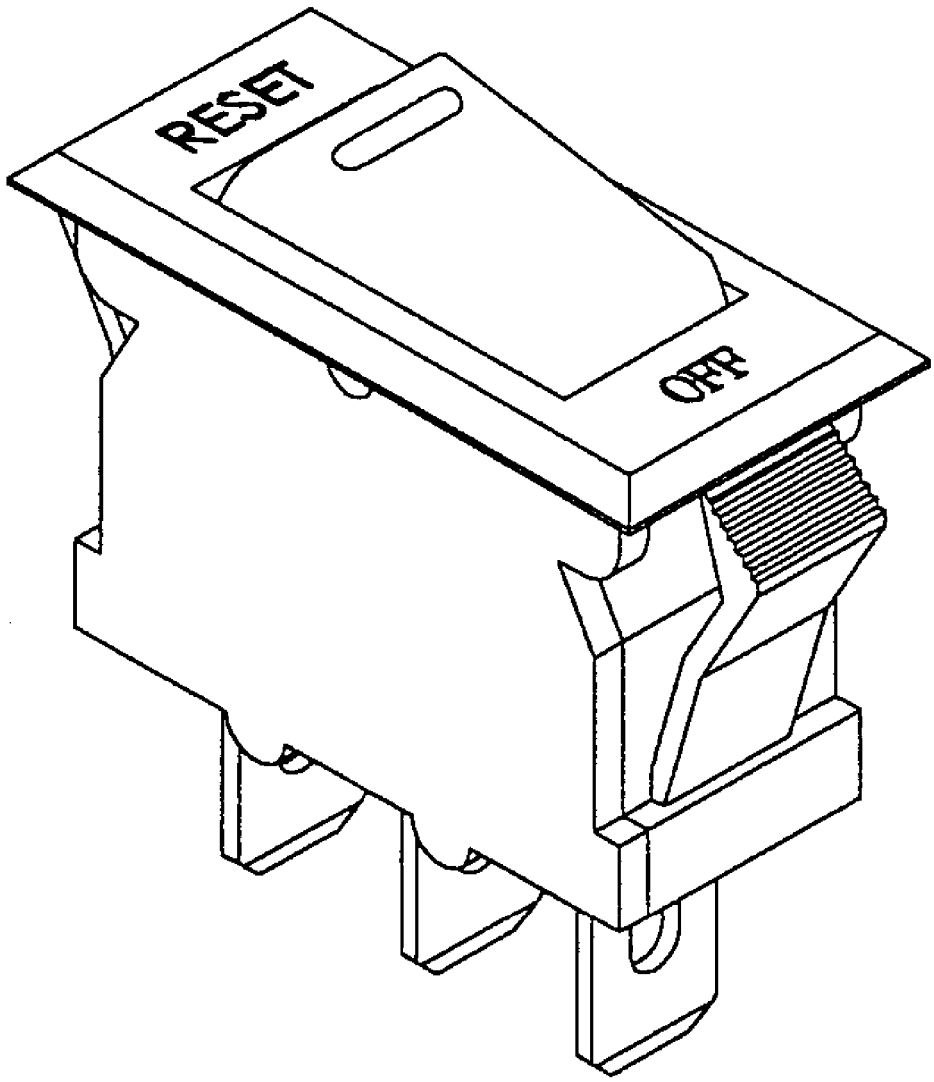
FIG. 5 is a three-dimensional view showing the external structure of the preferred embodiment of the present invention.

Third, when the rocker-switch 20 is pressed by external force or is under overloading condition while the circuit breaker is at the ON state, the bimetallic strip 50 bend in the opposite direction. This force causes the push-shaft 30 to press against the holding spring 33 towards the spring slot 13 on the housing 10. The push-shaft 30 makes the silver point 51 on the bimetallic strip 50 to move to the right direction. When the external force 80 is removed, the push-shaft 30 is pushed back to its original position by the spring force and brings the rocker-switch to its original OFF position as shown in FIGS. 4A and 4B.

As described herein, this improved circuit breaker structure is based on the mechanism of the spring force operating on the push-shaft and the pull-shaft connected to the tilted plate of the rocker-switch. This mechanism drives the bimetallic strip to complete the circuit breaking function intended as well as provides the ability of returning the rocker-switch to its original OFF position.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a circuit breaker comprising a housing, a rocker-switch, a push-shaft, a pull-shaft, a bimetallic strip, three terminals, an indicator, a side cover on said housing jointly forming a one-piece injection molded construction;

wherein said rocker-switch is installed on top of said housing, and a common terminal, a stationary terminal, as well as a moving terminal are all placed through the bottom of said housing; said push-shaft and said pull-shaft are pivotally connected to a tilted plate attached underneath said rocker-switch; said push-shaft is held inside a slot on said housing by a curved plate, an L-shaped plate, as well as a holding spring;

wherein said bimetallic strip, connected with a curved spring installed inside a V-shaped slot on an adjustment strip, is put inside a groove on said pull-shaft and rendering said push-shaft at the OFF state; and wherein a force exerted by spring pressed by said push-shaft causes said bimetallic strip to be separated from said moving terminal and to be held in place by said side cover on said housing.

2. The improved structure of said circuit breaker according to claim 1, wherein an arcing sliding track inside said housing moves said bimetallic strip when it is pressed against by a curved plate installed at the bottom of said push-shaft.

3. The improved structure of said circuit breaker according to claim 1, wherein said bimetallic strip has a silver point fabricated on a raised ridge on the topside of said bimetallic strip.

4. The improved structure of said circuit breaker according to claim 1, wherein the size of said adjustment strip is to be specified according to applications intended.

5. The improved structure of said circuit breaker according to claim 1, wherein said bimetallic strip has a round hole opened for easy replacement of said adjustment strip.

* * * * *